US008127781B2

(12) United States Patent
Cai

(10) Patent No.: US 8,127,781 B2
(45) Date of Patent: Mar. 6, 2012

(54) AUTOMATIC OPENING AND SHUTTING UMBRELLA

(76) Inventor: Rong-Tuan Cai, Xiamen (CN)

( * ) Notice: Subject to any disclaimer, the term of this patent is extended or adjusted under 35 U.S.C. 154(b) by 80 days.

(21) Appl. No.: 12/863,187

(22) PCT Filed: Jul. 6, 2009

(86) PCT No.: PCT/CN2009/072640

§ 371 (c)(1),
(2), (4) Date: Jul. 16, 2010

(87) PCT Pub. No.: WO2010/148576

PCT Pub. Date: Dec. 29, 2010

(65) Prior Publication Data

US 2011/0114142 A1 May 19, 2011

(30) Foreign Application Priority Data

Jun. 22, 2009 (CN) ..... 2009 1 0148298

(51) Int. Cl.
*A45B 25/14* (2006.01)

(52) U.S. Cl. ..... 135/22; 135/20.3; 135/24

(58) Field of Classification Search ..... 135/15.1, 135/22, 24, 25.4, 25.41, 20.3
See application file for complete search history.

(56) References Cited

U.S. PATENT DOCUMENTS

| | | | | |
|---|---|---|---|---|
| 7,798,160 | B2 * | 9/2010 | Chen | 135/24 |
| 7,971,595 | B1 * | 7/2011 | Ko | 135/24 |
| 2009/0133729 | A1 * | 5/2009 | Chong | 135/20.3 |
| 2010/0288317 | A1 * | 11/2010 | Huang | 135/24 |
| 2010/0319739 | A1 * | 12/2010 | Chong | 135/24 |
| 2011/0048479 | A1 * | 3/2011 | Kuo | 135/20.3 |
| 2011/0192435 | A1 * | 8/2011 | Ko | 135/24 |
| 2011/0226295 | A1 * | 9/2011 | Lo | 135/24 |
| 2011/0232707 | A1 * | 9/2011 | Wu et al. | 135/22 |

* cited by examiner

*Primary Examiner* — Noah Chandler Hawk

(57) ABSTRACT

An automatic collapsible umbrella (100) comprises an idle-popup resistant device (5) to avoid the telescopic stick (3) popping up unexpectedly while folding the umbrella and hurting the person close by. Said idle-popup resistant device (5) consists essentially of a tow rope (51), a ratchet wheel (52), a spiral spring (54) and a pawl (55). The ratchet wheel (52) and the pawl (55) are controlled by a locking head (45). The tow rope (51) passes through the telescopic stick (3) and an end thereof winds the ratchet wheel (52). By the installation of the ratchet and spiral spring (54), the telescopic stick (3) is allowed to move in unidirectional fashion and to be retracted gradually, improving the safety of the umbrella.

2 Claims, 6 Drawing Sheets

AUTOMATIC OPENING AND SHUTTING UMBRELLA

FIELD OF THE INVENTION

The present invention relates to an automatic collapsible umbrella having a mechanism to open and shut its frame automatically.

DESCRIPTION OF PRIOR ART

The conventional automatic opening/shutting umbrellas are usually equipped with mechanism that allows the user to open and close the umbrella by pressing a button but to collapse the telescopic shaft, user must push from both ends of the umbrella manually, requiring both hands and strength. For elder or minor users, insufficient strength may cause the shaft of the umbrella to extend unexpectedly, occurring idle-popup, which might hurt the user or person close by as well.

SUMMARY OF THE INVENTION

To overcome mentioned drawback, an automatic opening and shutting umbrella consists of a frame (1), a plurality of tension springs (2) attached to said frame (1), a central telescopic stick (3), an upper cap (6), a runner (7), a button (8), a main body (9), a handle (50), a guiding tube (10), an in-line spring (20) and a bumper spring (30).

The central telescopic stick (3) consists of an outer tube (31), a middle tube (32) and an inner tube (33), the guiding tube (10) is provided in the inner tube (33); said in-line spring (20) sheaths the guiding tube (10) and disposed between said inner tube (33) and guiding tube (10).

Said upper cap (6) is fixed onto the top of the outer tube (31) and said runner (7) is mounted slidably to said outer tube (31), the main body (9) is provided in the handle (50) and fixed onto the bottom of the outer tube (31).

The frame (1) connects said upper cap (6) and the runner (7), and each tension spring (2) connects said frame (1). Said button (8) is provided on said main body (9).

The present invention is characterized in that: said collapsible umbrella includes further an automatic opening/shutting system (4) and an idle-popup resistant device (5).

Said automatic opening/shutting system (4) consists essentially of a pulley seat (41), a first pulley wheel (42), a second pulley wheel (43), a string (44), a bullet shaped locking head (45), a tube (46), a stopper (47), a spring (48), a securing member (49), a securing spring (401), a sliding block (402) and a spring (403).

The pulley seat (41) is disposed in the outer tube (31) approximated to said upper cap (6); said first pulley wheel (41) is provide in the seat (41) and said second pulley wheel (43) is provided in the runner (7); an end of said sting (44) is attached to said upper cap (6), said string (44) passes both first and second pulley wheels (42, 43), allowing another end thereof passing said inner tube (33) and fixed to said bullet-shaped locking head (45).

Said tube (46) is provided at an end of said inner tube (33) and sized for allowing the bullet-shaped locking head (45) sliding therein. Said stopper (47) and the spring (48) are provided horizontally inside the main body (9) and an end of said stopper (47) butts a rear end of the locking head (45), securing the position thereof.

The securing member (49) and securing spring (401) are provided in the main body (9) horizontally and above said stopper (47); an end of said securing member (49) engages a slot provided at a bottom end of the outer tube (31).

Said sliding block (402) and spring (403) are freely attached to the end of the inner tube (33) respectively and said spring (403) is compressed between the sliding block (402) and main body (9).

Said idle-popup resistant device (5) comprising a tow rope (51), a ratchet wheel (52), a ratchet wheel supporter (53), a spiral spring (54), a pawl (55) and a restoring spring (56); said tow rope (51) having an end fixed to the pulley seat (41); the tow rope (51) passes through said inner tube (33), the bullet-shaped locking head (45) and having another end thereof winding said ratchet wheel (52); said ratchet wheel (52) has an axle whose both ends extend outwardly allowing the ratchet wheel (52) rotatably fixed to the ratchet wheel supporter (53), which is provided in the main body (9) and at an bottom end of the tube (46).

Said spiral spring (54) enwinds the axle of the ratchet wheel (52), an end of said pawl (55) pin jointed to the inner of the main body (9), a projection (551) extends horizontally and passes through a groove set on a side wall of said tube (46) butting the bullet-shaped locking head (45); said restoring spring (56) is provided between a back of the pawl (55) and inner wall of main body (9). The bumper spring (30) is installed in the outer tube (31) and is compressed between said middle tube (32) and the seat (41).

Since the catch and the locking head disengage easily, the conventional automatic umbrella may reopen and pop up suddenly, hurting the user. Therefore, the automatic umbrella claimed in the present invention includes an idle-popup resistant device (5) provided within the handle. The idle-popup resistant device (5) is composed of a tow rope (51), a ratchet wheel (52), a ratchet wheel supporter (53), a spiral spring (54), a pawl (55) and a restoring spring (56). The ratchet wheel (52) and pawl (55) engage to form a ratchet and is controlled by the locking head (45); with the installation of spiral spring (54), the middle tube (32) is pulled by the tow rope (51) and retracted gradually to prevent mentioned defect. By incorporating the idle-popup resistant device, the safety and service life of the automatic umbrella are improved. To prevent the user from press the button unwillingly, a movable cover (40) is further attached to the handle for covering the button.

The main improvement of the present invention is adding the idle-popup resistant device (4). Under the restriction of spring-force of the spiral spring (54), said middle tube (32) is pulled still by the idle-popup resistant tow rope (51) to achieve better control of shutting rhythm of the umbrella, so as to gradually shutting the umbrella, thus effectively preventing occurrence of idle-popup caused by incomplete push force during pushing the frame. The idle-popup resistant device (5) coexists with the automatic opening/shutting device (4) to supplement each other, lock each other without mutual interference; and the invention is compact in structure, high in safety and long in service life.

DETAILED DESCRIPTION OF PREFERRED EMBODIMENTS

The preferred embodiment of the present invention is described in detail according to the appended drawings.

Figure 1:
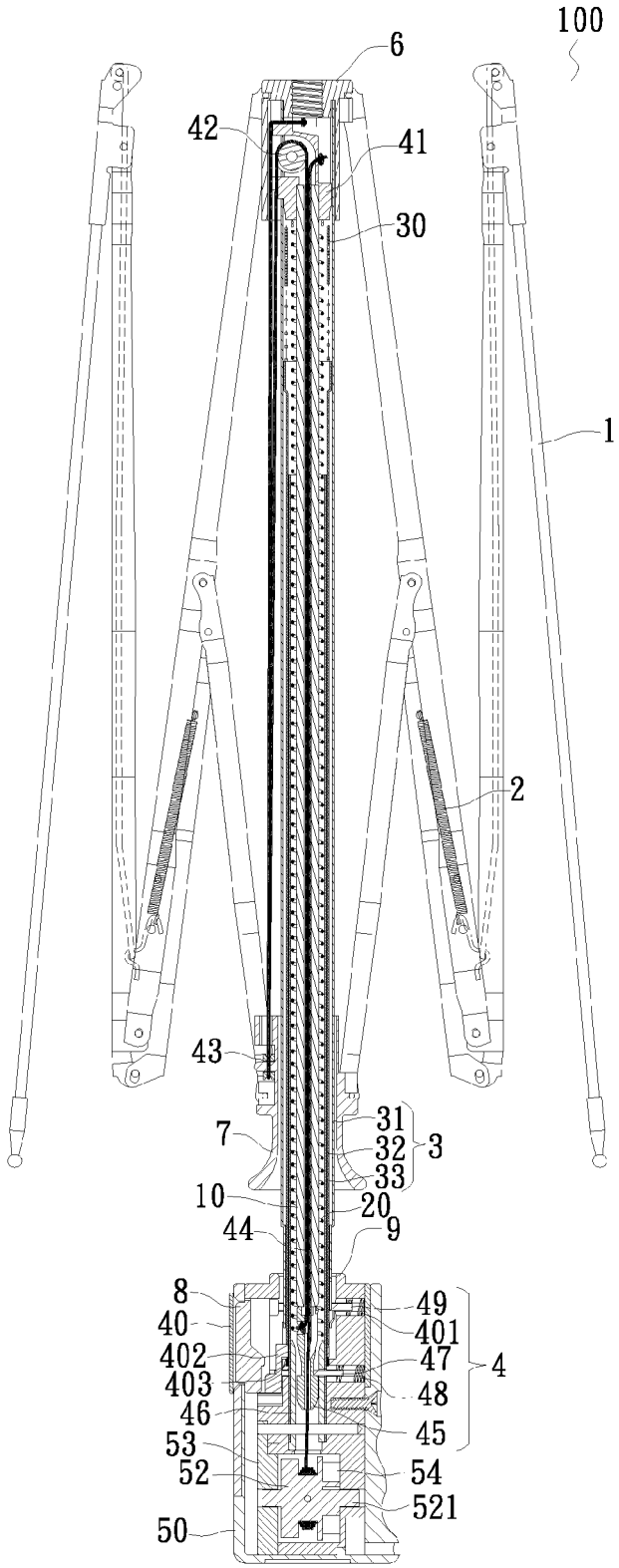
FIG. 1 is a sectional view of the present invention.

Referring to FIG. 1, an automatic collapsible umbrella (100) comprising a frame (1), a plurality of tension springs (2) attached to said frame (1), a central telescopic stick (3), an automatic opening/shutting system (4), an idle-popup resistant device (5), an upper cap (6), a runner (7), a button (8), a main body (9), a guiding tube (10), an in-line spring (20), a bumper spring (30), a movable cover (40) and a handle (50). Said automatic opening/shutting system (4) consists essentially of a pulley seat (41), a first pulley wheel (42), a second pulley wheel (43), a string (44), a bullet-shaped locking head (45), a tube (46), a stopper (47), a spring (48), a securing member (49), a securing spring (401), a sliding block (402) and a spring (403). Said pulley seat (41) is disposed in the outer tube (31) approximated to said upper cap (6). Said first pulley wheel (42) is provided rotatably in the seat (41) and said second pulley wheel (43) is provided rotatably in the runner (7). An end of said sting (44) is attached to said upper cap (6), said string (44) passes both first and second pulley wheels (42, 43), allowing another end thereof passing said inner tube (33) and fixed to said locking head (45). Said tube (46) is provided at an end of said inner tube (33) and sized for allowing the bullet-shaped locking head (45) sliding therein. Said stopper (47) and the spring (48) are provided horizontally inside the main body (9) and an end of said stopper (47) butts a rear end of the locking head (45), securing the position thereof.

The securing member (49) and securing spring (401) are provided in the main body (9) horizontally, above said stopper (47); an end of said securing member (49) engages a slot provided at a bottom end of the outer tube (31).

Said sliding block (402) and spring (403) are freely attached to the end of the inner tube (33) respectively and said spring (403) is compressed between the sliding block (402) and main body (9).

Figure 2:
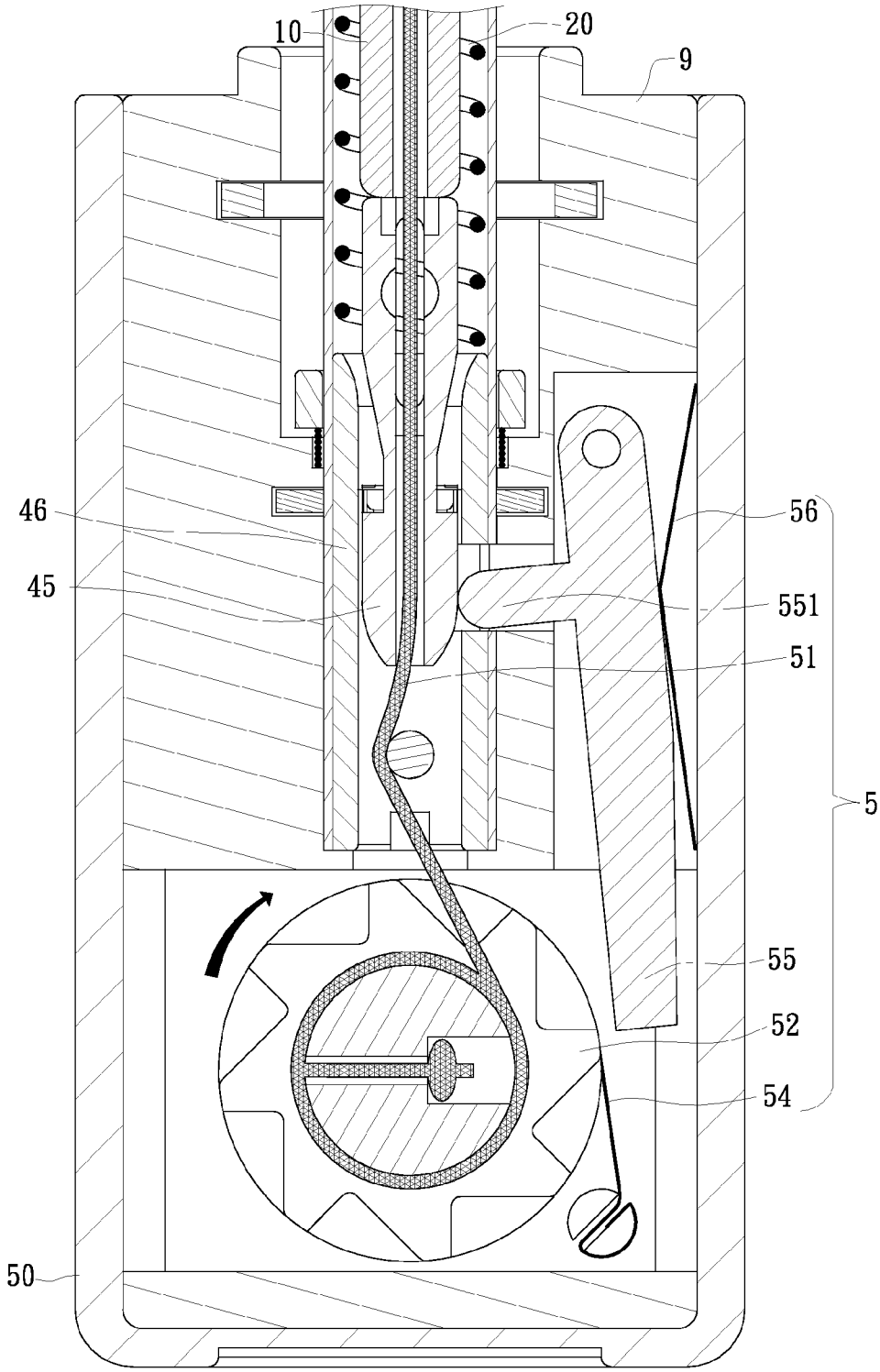
FIG. 2 is a schematic view of the idle-popup resistant device of the present invention.

As shown in FIGS. 1 and 2, said idle-popup resistant device (5) comprising a tow rope (51), a ratchet wheel (52), a ratchet wheel supporter (53), a spiral spring (54), a pawl (55) and a restoring spring (56). Said tow rope (51) having an end fixed to the pulley seat (41). The tow rope (51) passes through said inner tube (33), the bullet-shaped locking head (45) and having another end thereof winding said ratchet wheel (52). Said ratchet wheel (52) has an axle whose both ends extend outwardly, allowing the ratchet wheel (52) rotatably disposed on the ratchet wheel supporter (53), which is provided in the main body (9) and at an bottom end of the tube (46). Said spiral spring (54) enwinds the axle of the ratchet wheel (52), an end of said pawl (55) pin jointed to the inner of the main body (9), a projection (551) extends horizontally from the pawl (55) and passes through a groove set on a side wall of said tube (46) butting the bullet-shaped locking head (45). The restoring spring (56) is provided between the back of the pawl (55) and inner wall of main body (9).

Said central telescopic stick (3) consists of an outer tube (31), a middle tube (32) and an inner tube (33). The guiding tube (10) is provided in the inner tube (33); said in-line spring (20) sheaths the guiding tube (10) and disposed between said inner tube (33) and guiding tube (10).

Said upper cap (6) is fixed onto a top end of the outer tube (31) and said runner (7) is slidably mounted to said outer tube (31), the main body (9) is incorporated in the handle (50) and fixed onto a bottom end of the outer tube (31). The frame (1) connects said upper cap (6) and the runner (7), and each tension spring (2) connects said frame (1). The button (8) is provided on said main body (9).

A movable cover (40) is attached to said handle (50) by two rails provided on both lateral sides thereof to hood the button (8). The bumper spring (30) is located in the outer tube (31) and is compressed between said middle tube (32) and the seat (41).

By pushing the upper cap (6) and main body (9) inwardly and simultaneously, the telescopic stick (3) is collapsed as the outer tube (31) and securing member (49) are engaged. The in-line spring (20) is also compressed and the locking head (45) and the stopper (47) are engaged. The locking head (45) pushes the pawl (55) disengaging (52), deactivating the idle-popup resistant device (5). The bumper spring (30) is compressed in order to push the middle tube (32) and sliding block (402) downwardly. The sliding block (402) is moved until it engages the bottom of button (8) and secures the position of said stopper (47), thus it won't disengage with the locking head (45) unless the user desires to open the umbrella, avoiding damage caused by unexpected extension of stick (3). Above mechanism for opening the umbrella (100) can coexists with the idle-popup resistant mechanism without mutual interference.

Figure 4A:
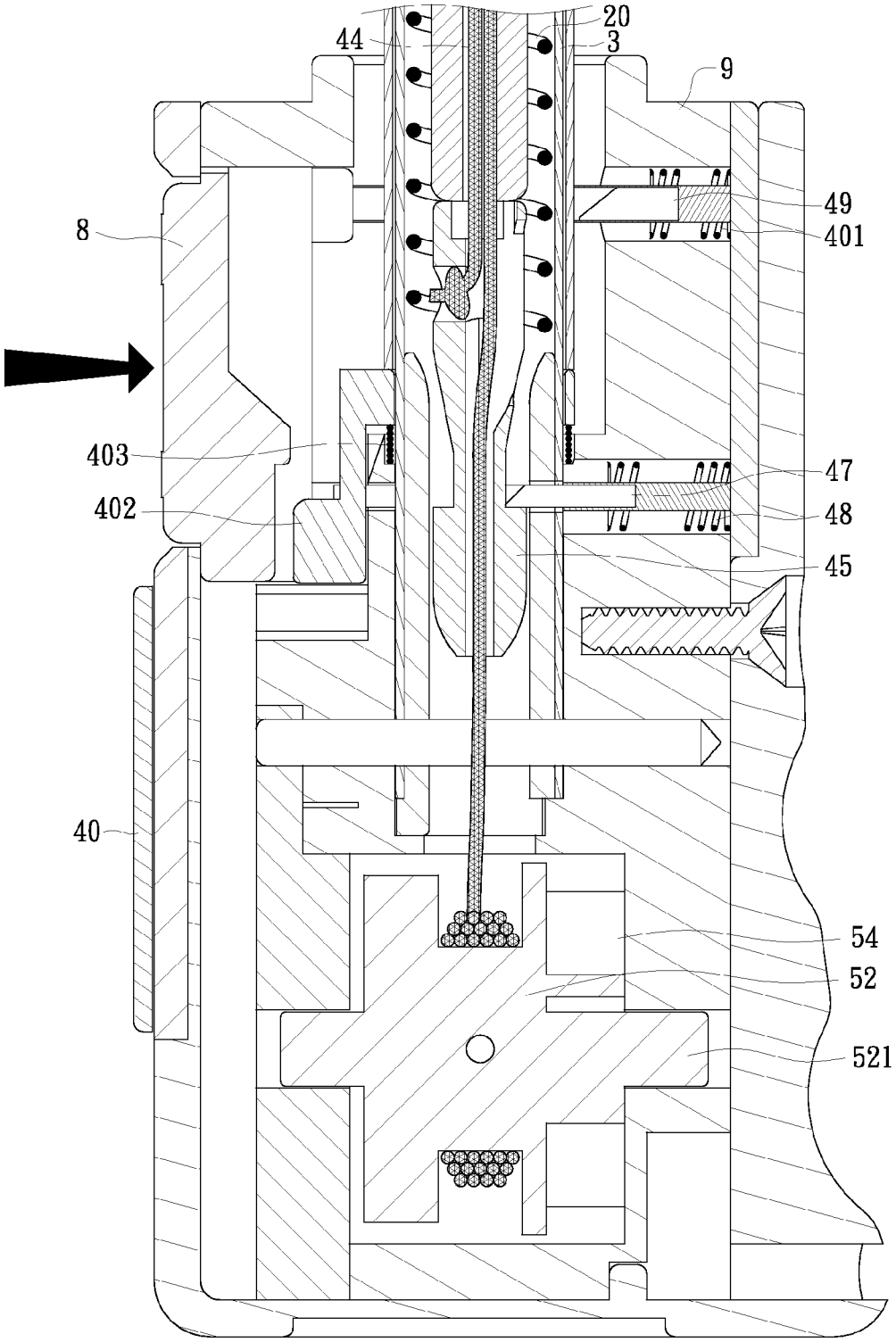
FIG. 4A is a schematic view of the present invention showing the automatic opening mechanism.
Figure 4B:
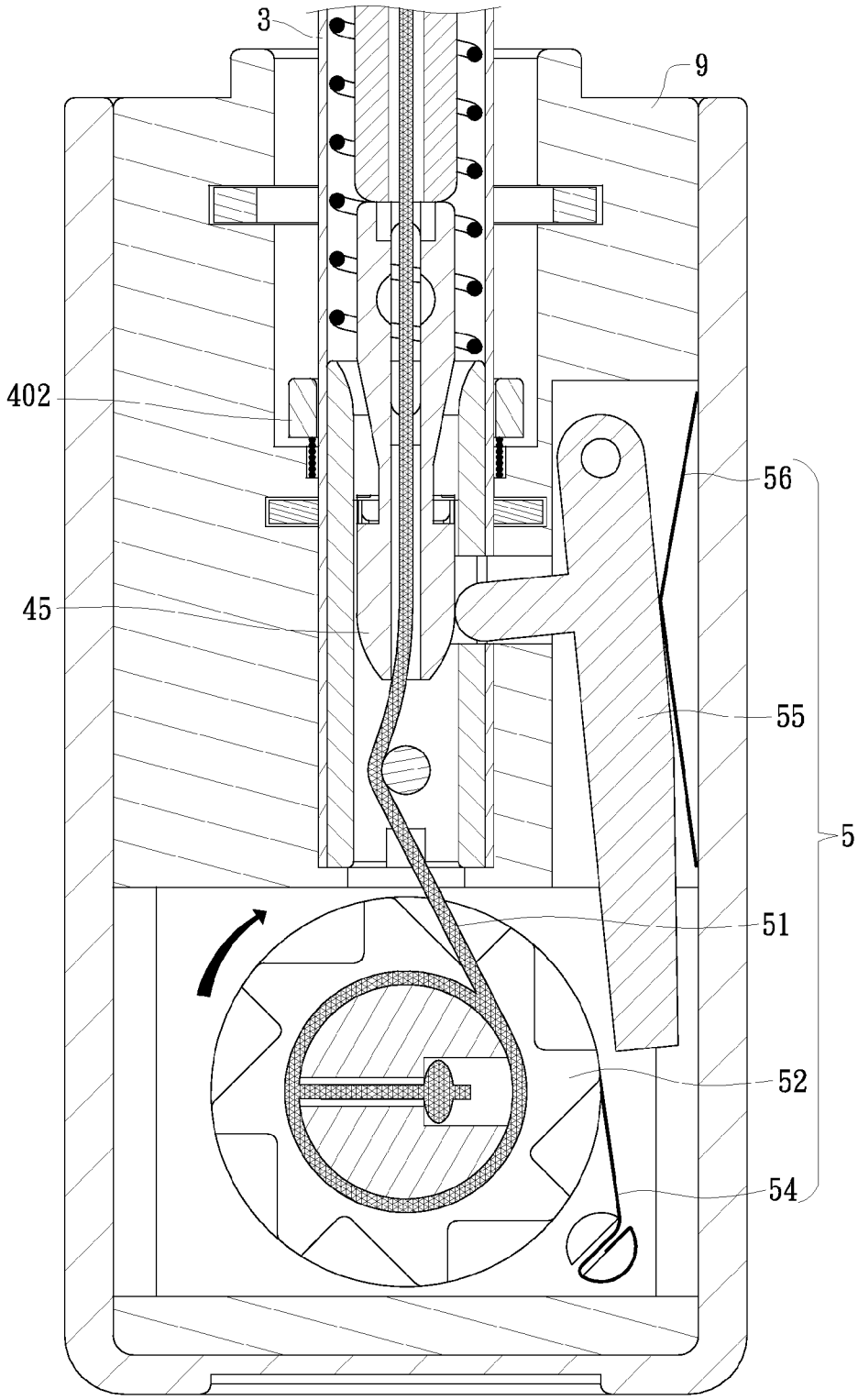
FIG. 4B is an enlarged view illustrating detail function of the idle-popup resistant device during the opening mechanism.

Referring to FIGS. 1, 4A and 4B, to open the umbrella (100), the button (8) is pressed to extend the telescopic stick (3). The in-line spring (20) is released, pushing the locking head (45) toward the opposite direction of the seat (41), stretching the string (44) where both end attached to said locking head (45) and seat (41) respectively. The stretched string (44) drags the runner (7) upwardly and unfolds the frame (1), opening the umbrella (100). At the same time, compressed bumper spring (30) is released, the sliding block (402) disengages from the button (8) and is pushed upwardly by the spring (403) while the pawl (55) disengaging the ratchet wheel (52) by the force of restoring spring (56).

Figure 3A:
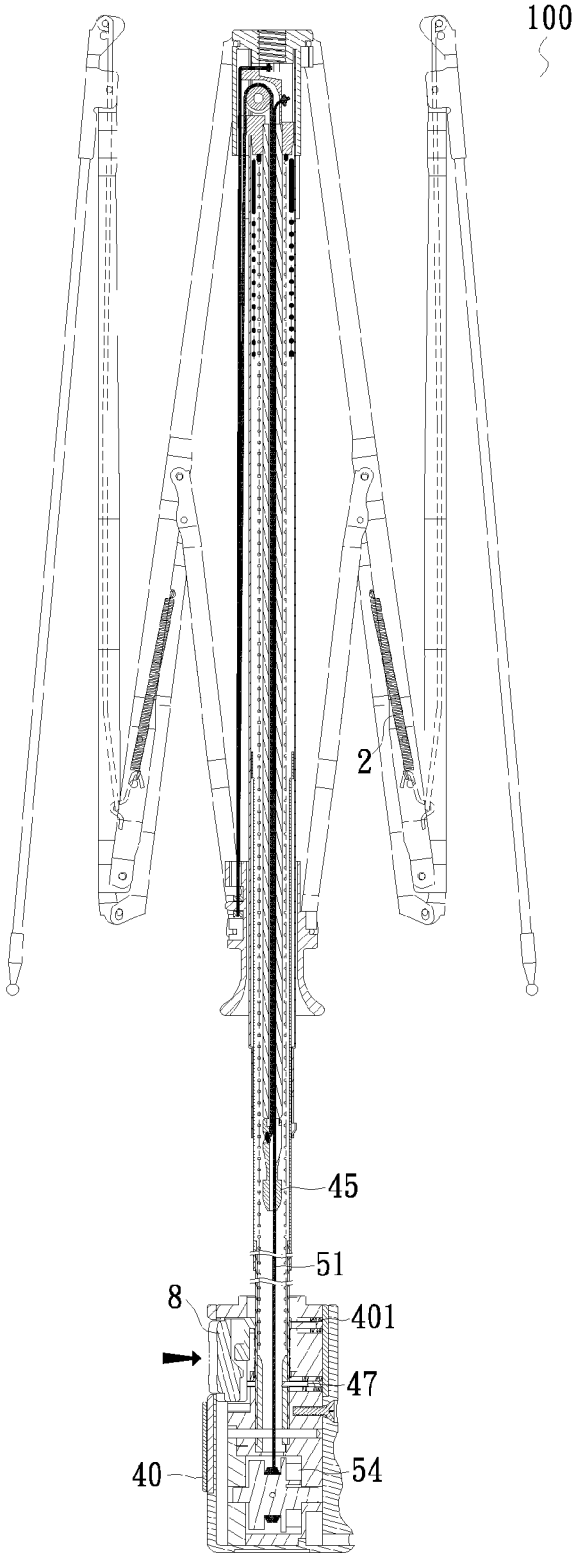
FIG. 3A is a schematic view of the present invention showing the automatic closing mechanism.
Figure 3B:
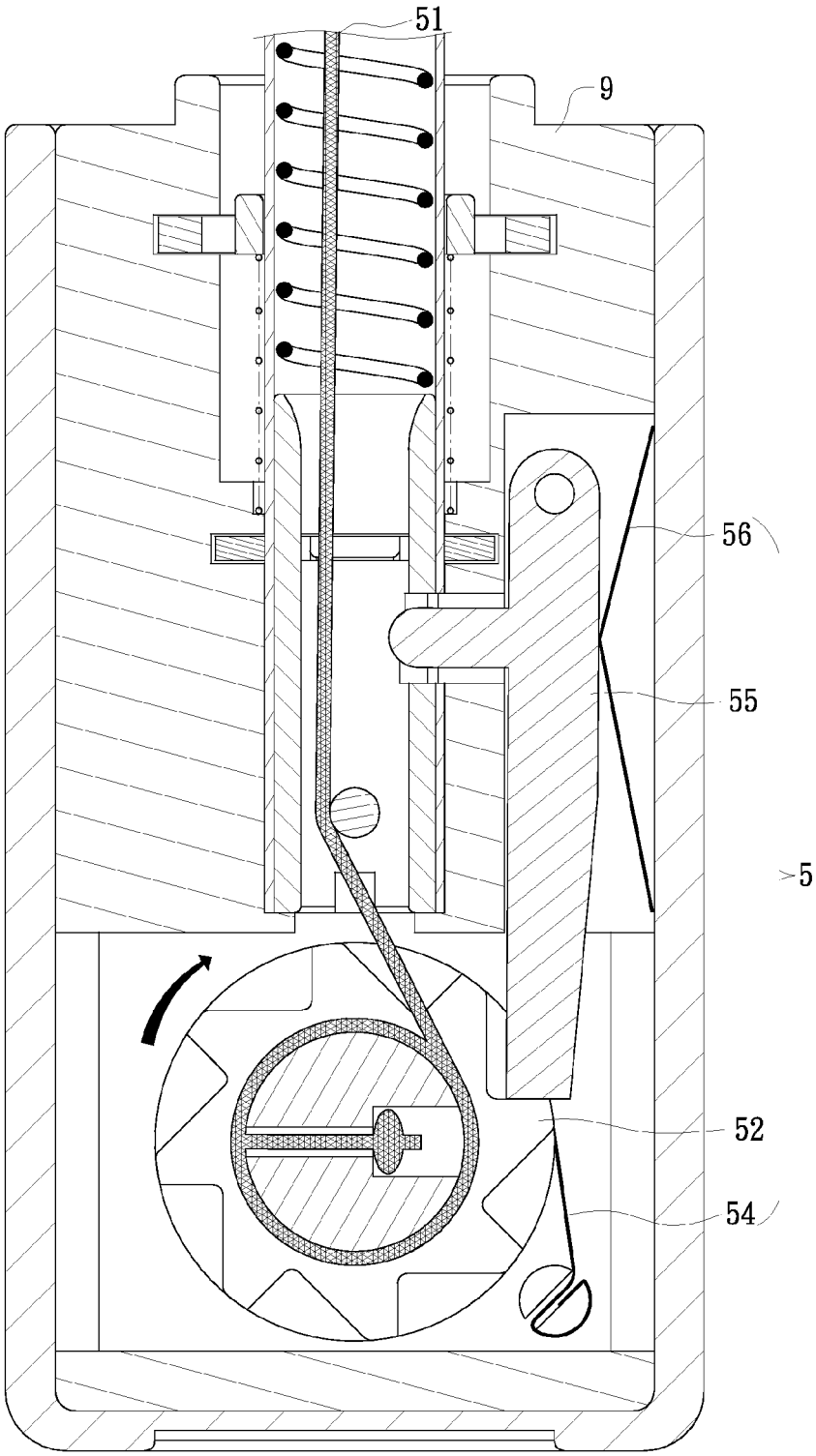
FIG. 3B is an enlarged view illustrating detail function of the idle-popup resistant device during the closing mechanism.

Referring to FIGS. 3A and 3B, to fold the umbrella (100), the button (8) is pressed again causing the locking head (45) disengage from the stopper (47). Said locking head (45) and string (44) are then pulled upwardly by the restoring force of tension spring (2) which attached to the frame (1). By engaging the pawl (55) with the ratchet wheel (52), the idle-popup resistant device (5) is activated and the tow rope (51) is winded by the force of the spiral spring (54). Therefore, when user releases the telescopic stick (3) while collapsing procedure, the middle tube (32) of the tube (3) is hold by the tow rope (51), allowing the telescopic tube (3) to move one direction only and to be retracted gradually, improving the security when folding the umbrella (100).

The idle-popup resistant device (5) coexists with the automatic opening/shutting device (4) to supplement each other, lock each other without mutual interference. Thus the idle-popup device (5) will be deactivated as the automatic opening/shutting device (4) functioning, and vice versa.

The invention claimed is:

1. An automatic collapsible umbrella (100) comprising a frame (1), a plurality of tension springs (2) attached to said frame (1), a central telescopic stick (3), an upper cap (6), a runner (7), a button (8), a main body (9), a handle (50), a guiding tube (10), an in-line spring (20) and a bumper spring (30);

said central telescopic stick (3) consists of an outer tube (31), a middle tube (32) and an inner tube (33); the guiding tube (10) is provided in the inner tube (33); said in-line spring (20) sheathing the guiding tube (10) and disposed between said inner tube (33) and guiding tube (10);

said upper cap (6) is fixed onto a top end of the outer tube (31) and said runner (7) is movably mounted to said outer tube (31), the main body (9) is provided in the handle (50) and fixed onto a bottom end of the outer tube (31);

said frame (1) connects said upper cap (6) and the runner (7) respectively; said button (8) is provided onto said main body (9);

characterized in that:

said collapsible umbrella (100) includes further an automatic opening/shutting system (4) and an idle-popup resistant device (5); said automatic opening/shutting system (4) consists essentially of a pulley seat (41), a first pulley wheel (42), a second pulley wheel (43), a string (44), a bullet-shaped locking head (45), a tube (46), a stopper (47), a spring (48), a securing member (49), a securing spring (401), a sliding block (402) and a spring (403);

said pulley seat (41) is disposed in the outer tube (31) approximated to said upper cap (6); said first pulley wheel (42) is provide in the seat (41) and said second pulley wheel (43) is provided in the runner (7);

an end of said string (44) is attached to said upper cap (6), said string (44) passes over both the first and second pulley wheels (42, 43), allowing another end thereof passing said inner tube (33) and fixed to said bullet-shaped locking head (45);

said tube (46) is provided at an end of said inner tube (33) and sized for allowing the bullet-shaped locking head (45) sliding therein; said stopper (47) the spring (48) are provided horizontally inside the main body (9) and an end of said stopper (47) butts a rear end of the locking head (45), securing the position thereof;

the securing member (49) and securing spring (401) are provided in the main body (9) horizontally and above said stopper (47); an end of said securing member (49) engages a slot provided at a bottom end of the outer tube (31);

said sliding block (402) and spring (403) are freely attached to the end of the inner tube (33) respectively and said spring (403) is compressed between the sliding block (402) and main body (9);

said idle-popup resistant device (5) comprising a tow rope (51), a ratchet wheel (52), a ratchet wheel supporter (53), a spiral spring (54), a pawl (55) and a restoring spring (56); said tow rope (51) having an end fixed to the pulley seat (41); the tow rope (51) passes through said inner tube (33), the bullet-shaped locking head (45) and having another end thereof winding said ratchet wheel (52); said ratchet wheel (52) has an axle whose both ends are extended outwardly allowing the ratchet wheel (52) rotatably provided on the ratchet wheel supporter (53), which is provided in the main body (9) and at an bottom end of the tube (46); said spiral spring (54) enwinds the axle of the ratchet wheel (52), an end of said pawl (55) pin jointed to the inner of the main body (9), a projection (551) is extended horizontally from the pawl (55) and passes through a groove set on a side wall of said tube (46) butting the bullet-shaped locking head (45); said restoring spring (56) is provided between a rear side of the pawl (55) and inner wall of main body (9); said bumper spring (30) is located in the outer tube (31) and is compressed between said middle tube (32) and the seat (41).

2. The automatic collapsible umbrella of claim 1, wherein the umbrella (100) includes further a movable cover (40) attached to said handle (50) by two rails provided on both lateral side thereof.

* * * * *